United States Patent [19]

Stone

[11] Patent Number: 4,463,852

[45] Date of Patent: Aug. 7, 1984

[54] ARTICLE CARRIER

[75] Inventor: James L. Stone, Wyoming, Mich.

[73] Assignee: Packaging Corporation of America, Evanston, Ill.

[21] Appl. No.: 469,203

[22] Filed: Feb. 24, 1983

Related U.S. Application Data

[63] Continuation of Ser. No. 206,011, Nov. 12, 1980, abandoned.

[51] Int. Cl.[3] ..... B65D 5/36; B65D 5/46

[52] U.S. Cl. ..... 206/427; 206/141; 229/40; 229/52 BC

[58] Field of Search ..... 206/140, 141, 155, 158, 206/427, 434; 229/40, 52 B, 52 BC

[56] References Cited

U.S. PATENT DOCUMENTS

| | | | |
|---|---|---|---|
| Re. 29,063 | 12/1976 | Graser | 206/143 |
| 3,035,692 | 5/1962 | Forrer | 206/140 |
| 3,163,321 | 12/1964 | Weiss | 206/140 |
| 3,381,881 | 5/1968 | Ganz et al. | 206/140 |
| 3,679,121 | 7/1972 | Morgese | 206/140 |
| 3,692,232 | 9/1972 | Helms | 229/52 BC |
| 4,034,852 | 7/1977 | Forrer | 206/141 |
| 4,256,226 | 3/1981 | Stone | 206/140 |
| 4,300,680 | 11/1981 | Champlin | 206/141 |

*Primary Examiner*—Joseph Man-Fu Moy

*Attorney, Agent, or Firm*—Neuman, Williams, Anderson & Olson

[57] ABSTRACT

A carrier is provided for accommodating a plurality of articles. The carrier includes a base panel, wall panels extending upwardly from opposite peripheral portions thereof, and a handle foldably connected to upper portions of the wall panels and spanning the distance therebetween. The handle is provided with a center section having a pair of longitudinally spaced fingerholes formed therein. Each hole has a foldable tab which is substantially defined by a curved cut, the end portions of which are curved opposite from one another. The portion of the center section disposed intermediate the curved end portions of each cut provides the folding connection between the tab and the center section.

4 Claims, 8 Drawing Figures

ARTICLE CARRIER

This is a continuation of application Ser. No. 206,011 filed Nov. 12, 1980, now abandoned, the text of which is hereby incorporated by reference.

BACKGROUND OF THE INVENTION

Merchandising of beverages, such as beer, soft drinks, etc., in four, six, or eight packs has become increasingly popular with retailers because of convenience, cost, and esthetic appeal. Such packs, normally include carriers formed from one or more blanks of foldable sheet material (e.g., paperboard having one surface thereof suitable for printing and graphic indicia). The style and size of the carrier may vary over a wide range; however, there are certain important criteria for such carriers: namely, (a) it must be inexpensive and compact; (b) it must be capable of withstanding abusive treatment when subjected to normal handling by the wholesaler, the retailer and the customer; (c) it must be sturdy and suitable for stacking; (d) it must be convenient and comfortable for being manually carried; (e) it must be of simple construction and capable of being loaded by high-speed automatic loading equipment commonly used by bottlers and the like; (f) the carrier must provide adequate protection for the accommodated articles (e.g., bottles) in accordance with recognized packaging standards; and (g) with the advent in many locales of required use of returnable bottles and other containers, there is a need for a carrier which is capable of conveniently accommodating a plurality of the bottles or containers when empty and thereby greatly facilitate the handling of same by the customer.

Various carriers of this general type have heretofore been provided; however, because of certain inherent design characteristics they have fallen short of meeting all of these criteria.

One of the more critical problems heretofore encountered relates to the carrier handle being highly susceptible to tearing when the loaded carrier is subjected to normal handling. Such tearing is caused in part by the thinness or other inherent physical characteristics of the paperboard material normally used in forming the carrier blank. Remedies toward resolving this problem have included increasing the thickness of the paperboard utilized; reinforcing the handle with inserts affixed thereto; and/or changing the configuration of the carrier itself. Such remedies, however, are beset with one or more of the following serious shortcomings: (a) the thicker paperboard material significantly increased the material costs of the carrier; (b) the carrier blank with the reinforced handle was of a complex configuration and was difficult and awkward to set up with high-speed automatic equipment, and (c) the carrier was unstable and uncomfortable to manually carry.

SUMMARY OF THE INVENTION

Thus, it is an object of the invention to provide an improved article carrier which effectively avoids the aforenoted problems.

It is a further object to provide an improved article carrier which is capable of readily accommodating a plurality of articles which may vary in size and shape over a wide range.

It is a further object to provide an improved article carrier which may be readily stored in a collapsed state and subsequently be conveniently setup for loading.

It is a still further object to provide an improved article carrier which is of simple, inexpensive construction and yet is effective in providing adequate protection for the articles when initially loaded in the carrier.

Further and additional objects will appear from the description, accompanying drawings, and appended claims.

In accordance with one embodiment of the invention, an article carrier is provided which is formed from a blank of foldable sheet material. The carrier is adapted to initially assume a first mode for accommodating and retaining a plurality of filled articles in a predetermined arrangement, and to subsequently assume a second mode for accommodating a plurality of empty articles. The carrier includes a base panel for supporting and subtending the accommodated articles when the carrier is in either mode. Extending upwardly from opposite peripheral portions of the base panel are wall panels. The upper portions of the wall panels are foldably connected to the ends of a handle which span the distance between the wall panels. The handle includes an elongated center section having centrally aligned, longitudinally spaced fingerholes formed therein. Each fingerhole is provided with a tab which is substantially defined by a curved cut, the latter having oppositely curved end portions. The segment of the center section disposed between the end portions of each cut provides the folding axis for the tab. When the carrier is being manually carried, fingers of the person carrying same extend into the fingerholes and cause the tabs thereof to be folded inwardly towards the base panel.

DESCRIPTION

For a more complete understanding of the invention reference should be made to the drawings wherein.

Figure 4:
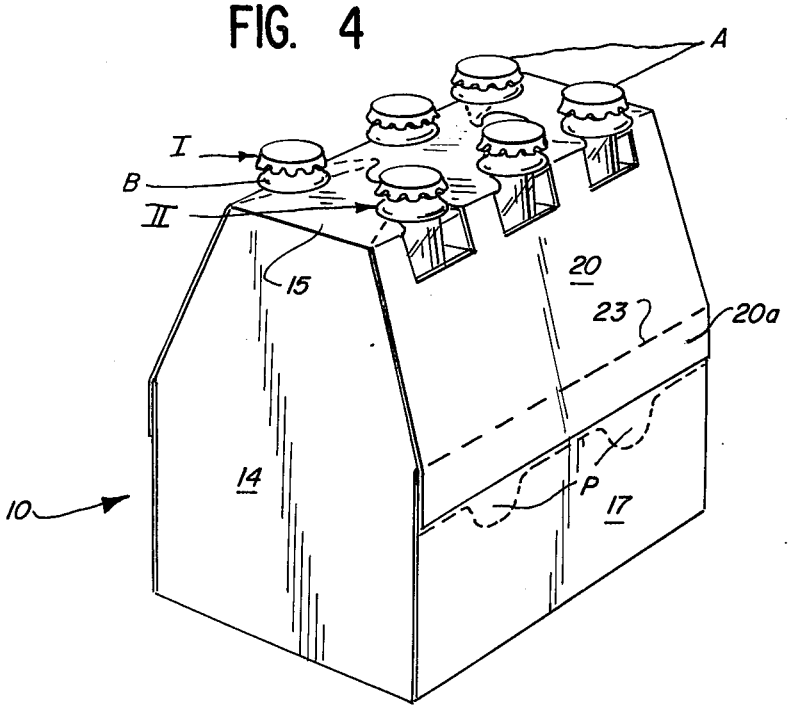
FIG. 4 is a perspective side view of the blank of FIG. 1 fully set up and initially loaded.

Referring now to the drawings and more particularly to FIG. 4, one form of the improved carrier 10 is shown in a first mode wherein a plurality of articles A are initially accommodated therein. The articles A, for purposes of illustration, are conventional, returnable, glass bottles normally used in the marketing of beverages and the like. The number and types of articles A accommodated by the carrier may vary from that shown.

Carrier 10 is formed from a single blank 11 of foldable sheet material (e.g., paperboard) having one surface thereof treated to receive printed indicia and/or graphics. Blank 11, as shown in FIG. 1, has a configuration for accommodating six articles arranged in two parallel rows I, II of three each, when fully set up to form the carrier 10.

Figure 1:
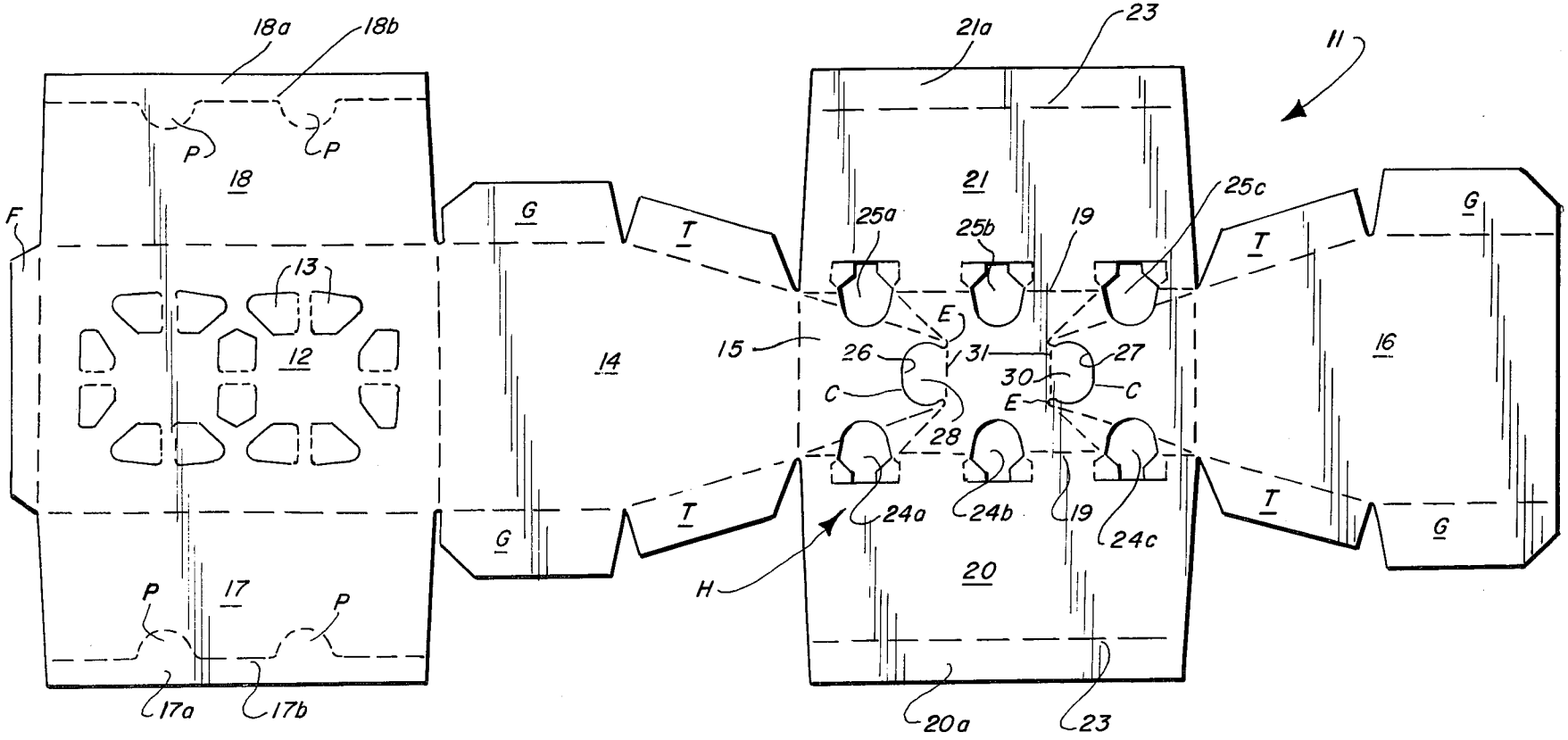
FIG. 1 is a top plan view of a blank for one form of the improved carrier.

Blank 11, as seen in FIG. 1, includes a base panel 12 of rectangular configuration and having a plurality of strategically arranged conventional push-up tabs 13 which serve to separate the bottom portions of adjacent articles and prevent same from contacting one another when accommodated within the set up carrier. The utilization of push-up tabs for this purpose is well known in the art.

Foldably connected to one of the narrow end edges of the base panel 12 is an end wall panel 14. A conventional manufacturer's glue flap F is foldably connected to the opposite narrow end edge of base panel 12.

Foldably connected to end wall panel 14 and disposed in opposed relation with respect to the base panel is an elongated center section 15 which forms a part of a handle H for the carrier.

Opposite end wall panel 14 and foldably connected to the handle center section 15 is a second end wall panel 16. The end wall panels 14, 16 are of like configuration with the upper portions thereof tapered towards the center section 15, see FIGS. 4 and 5. The shape and size of the end wall panels 14, 16 will be determined to a great extent by the type of articles to be initially accommodated within the carrier.

Foldably connected to the opposite elongated side edges of the base panel 12 are side wall panels 17, 18. When the carrier is fully set up, end wall panels 14, 16 assume upright, substantially parallel relation and the side wall panels 17, 18 likewise assume upright, substantially parallel relation, but at substantially right angles with respect to the end wall panels. The end and side wall panels maintain their proper relative relation by a plurality of conventional glue flaps G which are foldably connected to the side edges of the end wall panels 14, 16. The end and side wall panels and the base panel coact with one another to form a chamber in which the rows of articles are disposed.

In order to retain the accommodated articles within the chamber when the carrier is initially loaded, and to provide an effective light shield for the articles, a pair of elongated side sections 20, 21 is provided. One side section is connected by a foldline 19 to an elongated side edge of the handle center section 15, see FIG. 1. When the carrier is fully set up and initially loaded, each side section 20, 21 is folded downwardly and outwardly from the handle center section 15 and has the lower edge portion 20*a*, 21*a* thereof adhesively secured in overlapping relation to the upper edge portion 17*a*, 18*a* of the corresponding side wall panels 17, 18. The lower edge portions 20*a*, 21*a* of the side sections are foldable about foldlines 23, thereby facilitating opening of the carrier when the individual articles are to be initially removed from the carrier.

The overlapped upper edge portions 17*a*, 18*a* of the side wall panels 17, 18 are segregated from the remainder of the respective panels by tear scores 17*b*, 18*b*. When the loaded carrier is to be initially unloaded, the upper edge portions 17*a*, 18*a* are separated from the remainder of the side wall panels by merely pushing in the tonguelike projections P which extend below the lower edge of the side sections, see FIG. 4.

The length of each side section is coextensive with that of the side wall panel to which it is initially secured and thus, the corresponding side section and side wall panel provide an effective light shield, see FIG. 4.

Figure 3:
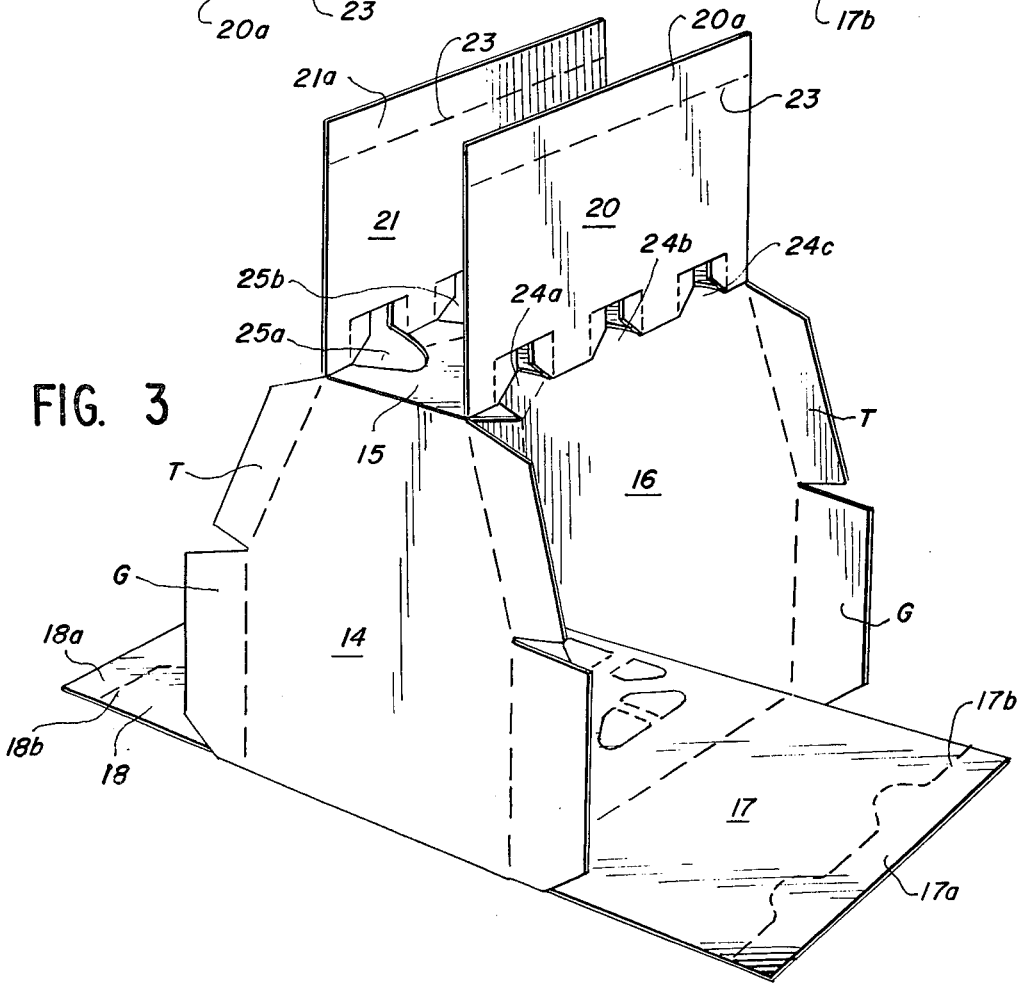
FIG. 3 is a perspective side view of the blank of FIG. 2 set up for initial side loading of a plurality of articles.

As will be observed in FIG. 1, the foldlines 19 which connect the side sections to the center section 15 of the handle H are interrupted by a plurality of longitudinally spaced openings 24*a, b,* and *c;* 25*a, b,* and *c*. The number of openings in a given foldline corresponds to the number of articles A comprising a row I, II. One portion of each opening extends into the center section 15 and a second portion of each opening extends into the corresponding side section. Such an arrangement of these openings is well known in the art. The shape of the portion of each opening extending into the center section is such that only the segment of the neck of the article, disposed beneath an annular bead B formed in the upper end of the article, will be slidably accommodated therein, when the side section is folded upwardly relative to the center section 15 during loading of the carrier, see FIG. 3. Once the article neck segments are located in the openings along the side edges of the center section, the glue flaps G are folded inwardly towards one another and then the side wall panels 17, 18 are folded to upright positions and secured to the glue flaps G. Tuck flaps T, which are also foldably connected to the tapered side edges of the end wall panels 14, 16, are then folded inwardly towards one another. The side sections 20, 21 are then folded downwardly and outwardly from their upright loading positions, see FIG. 3, and secured to the upper edge portions of the side wall panels. When the side sections are in their downwardly and outwardly folded positions, the necks of the accommodated articles are substantially locked in place and are prevented from contacting or striking one another because of the coaction of the push-up tabs 13 formed in the base panel 12.

The center section 15 of the handle H is provided with a pair of spaced fingerholes 26, 27 which are substantially aligned with the longitudinal centerline of the center section. Each fingerhole is transversely aligned with the spacing between adjacent openings 24*a–c*, 25*a–c* formed along the foldlines 19 connecting the side sections 20, 21 to the center section.

Figure 2:
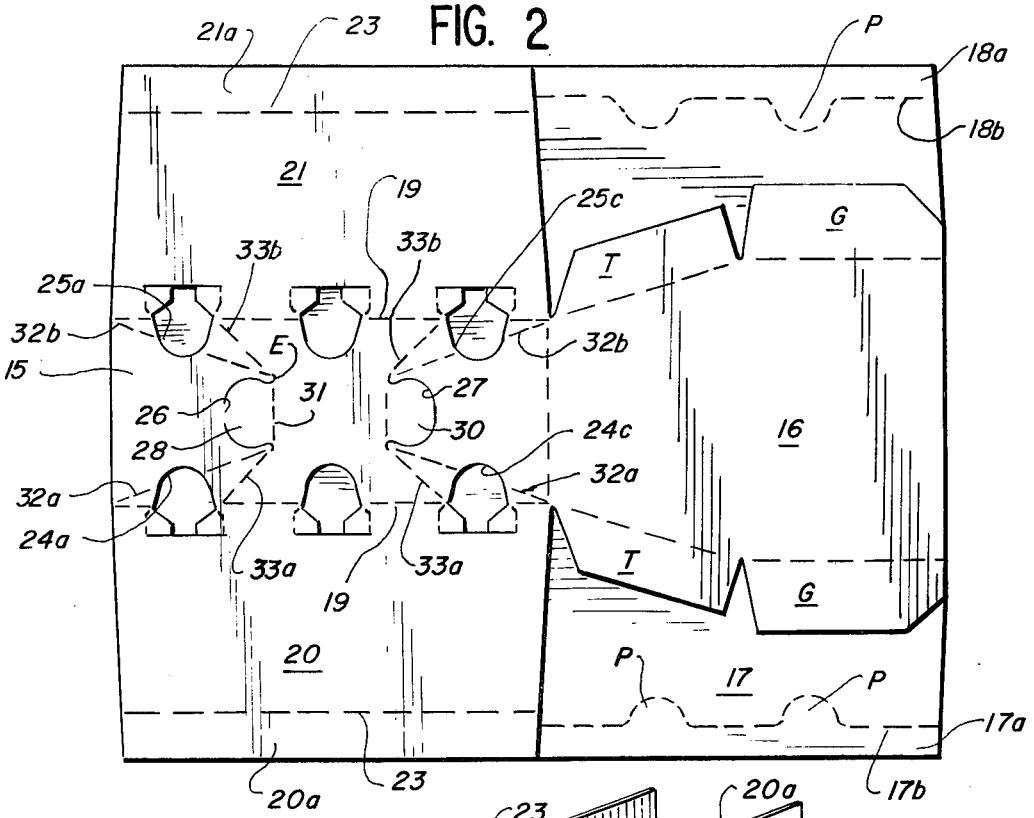
FIG. 2 is a top plan view of the blank of FIG. 1 in a collapsed folded state.

As will be seen in FIGS. 1 and 2, each fingerhole 26, 27 is provided with a tab 28, 30 which in each instance is substantially defined by a curved cut C. The cut in the illustrated embodiment is loop-shaped with the end portions E thereof oppositely curved with respect to one another. In FIGS. 1, 2, the end portions E curve outwardly away from each other and the radius of curvature of each end portion is relatively small (e.g., 3/32").

Figure 8:
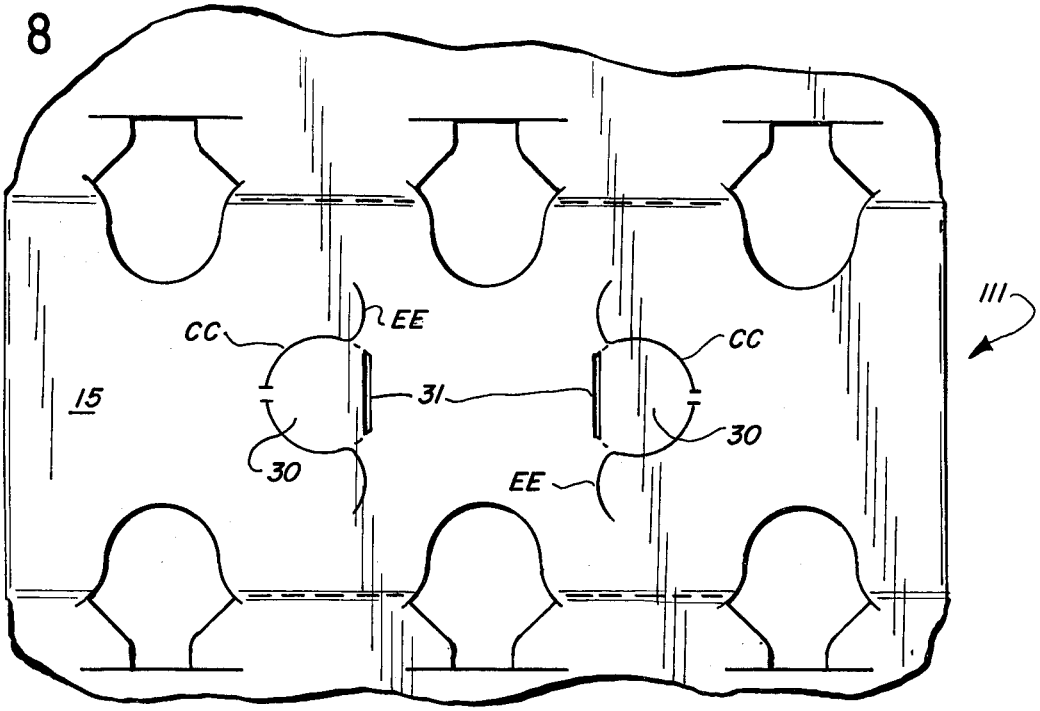
FIG. 8 is an enlarged fragmentary top plan view of a blank for a second form of the improved carrier.

In the modified form of blank 111, shown in FIG. 8, the end portions EE of the fingerhole cuts CC curve outwardly relative to one another to a substantially greater extent with the radius of curvature of each end portion being substantially greater (e.g., $\frac{3}{8}$").

In all variations of the fingerhole cuts, it is preferred that the grain of the paperboard utilized in forming the blank run in a direction which is substantially parallel to the center longitudinal axis of the center section 15.

Formed between the end portions of each fingerhole cut C, CC is an elongated folding score 31 which extends substantially transversely of the center longitudinal axis of section 15. The folding score 31 substantially spans the distance between the cut end portions. The scores 31 are disposed in spaced, substantially parallel relation. The spacing between folding scores 31 should be such (e.g., $2\frac{1}{8}$") that it will be comfortable for an adult person to insert a thumb and a finger in the fingerholes. As will be observed in FIGS. 2 and 8, each tab 30 has a maximum width portion, which is spaced from the folding axis 31 of the tab, and has a dimension greater than the length of the axis when measured parallel to the axis 31. Thus, convergence of the sides of the tab from the maximum width portion to the axis 31 is assured.

As seen more clearly in FIGS. 1 and 2, the handle center section 15 is provided with pairs of divergent scorelines 32*a*, 32*b*, and 33*a*, 33*b* for each fingerhole 26, 27. Similar scorelines may be provided in blank 111, if desired; but in FIG. 8 have been omitted. Scorelines 32*a*, 32*b* define a smaller included angle than that of scorelines 33*a*, 33*b*, and extend from the cut end portions E and terminate at the intersection of the end edge of the center section 15 and the foldline 19. A segment of each scoreline 32*a*, 32*b* may be interrupted by the portion of the endmost opening 24*a*, 25*a* or 24*c*, 25*c* which is formed in the center section 15.

The second pair of scorelines 33*a*, 33*b* for each fingerhole extend divergently from the cut end portions to substantially the intersection of the foldline 19 and the endmost openings 24*a*, 25*a*, 24*c*, 25*c* formed in the handle. It has been found through testing that the pairs of divergent, scorelines effect reinforcement of the center section, particularly in the so-called critical areas; namely, in the vicinity of the cut end portions E, EE.

Figure 6:
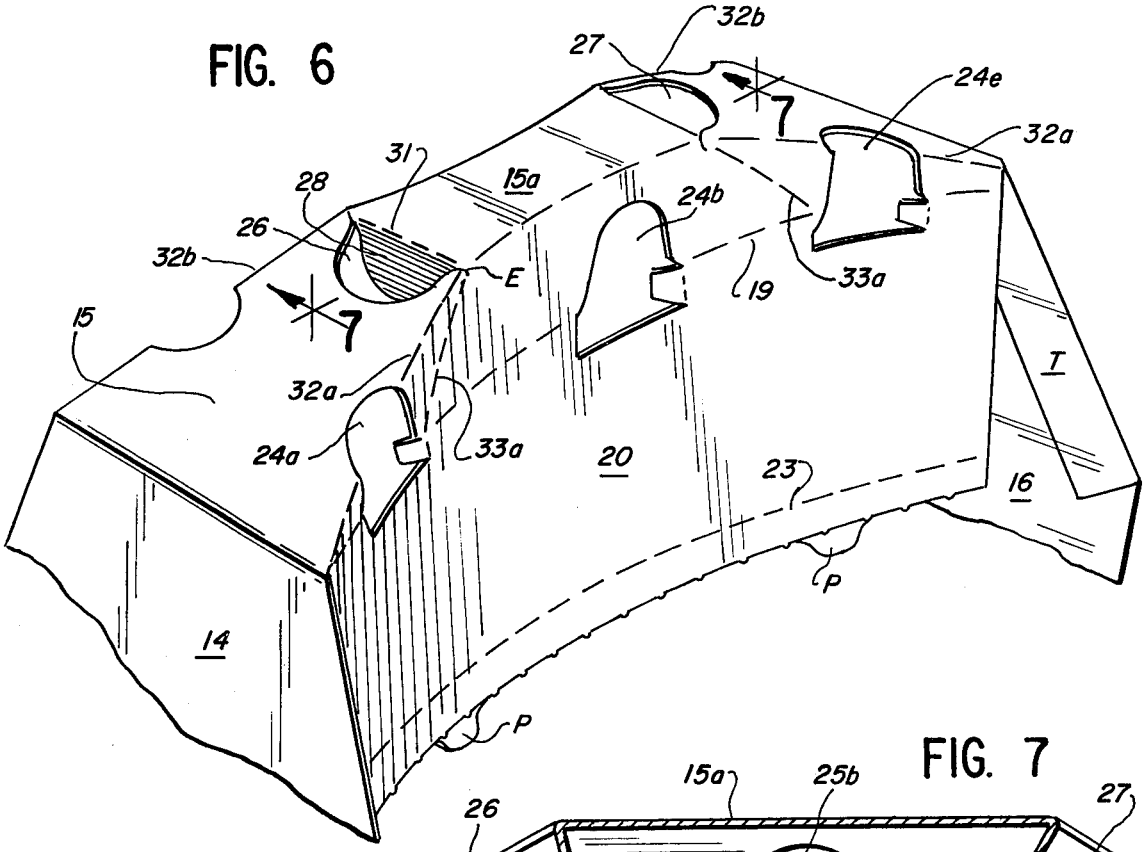
FIG. 6 is an enlarged fragmentary perspective view of the handle embodied in the improved carrier when the latter is in the mode shown in FIG: 5.

In addition, the scorelines 32*a*, 32*b*, facilitate converting the carrier from its first mode of set up, as seen in FIG. 4, to its second mode of set up, as seen in FIG. 6.

In the first mode, the articles A are initially accommodated within the carrier and are restrained by the folded side sections 20, 21 of the handle from being accidentally removed therefrom. The carrier assumes the first mode when it is being merchandized by the retailer, and in such state may be readily stacked or placed on a display shelf or counter. When it is to be picked up by the customer, the thumb and finger of one hand are inserted into the fingerholes 26, 27 causing the tabs 28, 30 thereof to be folded downwardly into the interior of the carrier and between the rows of accommodated articles, see FIG. 7.

Figure 5:
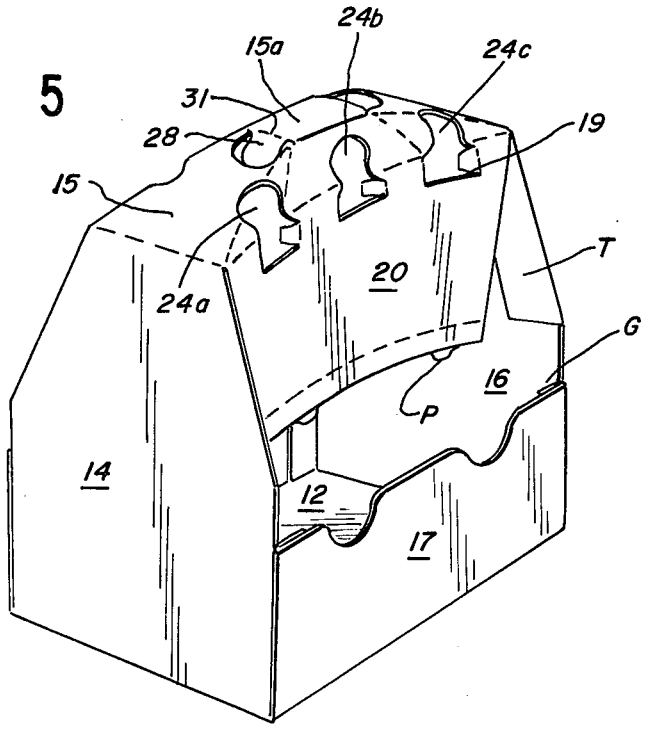
FIG. 5 is a perspective side view of the improved carrier in a mode for receiving returnable articles (e.g., bottles).

After the carrier has been initially opened, as aforedescribed, and the articles removed therefrom, the side sections 20, 21 are folded downwardly relative to the center section thereby converting the carrier into a second mode, see FIG. 5. When in the second mode, the carrier is a basket-style receptacle with the depending side sections 20, 21 defining a partial partition which separates the two rows of articles disposed within the carrier.

Figure 7:
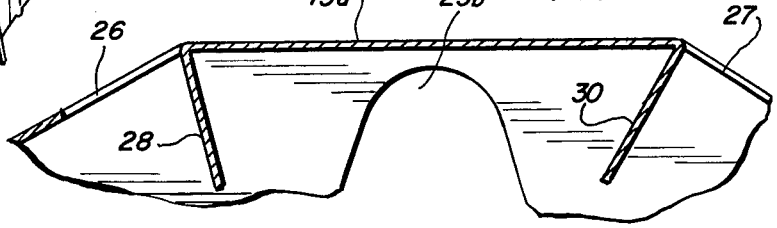
FIG. 7 is an enlarged fragmentary sectional view taken along line 7—7 of FIG. 6.

As will be seen in FIGS. 6 and 7, the handle center section 15 will assume an upwardly bowed configuration with the segment 15*a* of the center section located between the fingerholes 26, 27, remaining in a substantially planar condition.

When the carrier is in the second mode, the empty articles may be readily loaded into, or removed from, the carrier through the open top of the chamber disposed to one side of the depending handle side sections.

In manually carrying the carrier, while in the second mode, the thumb and finger are again inserted into the exposed fingerholes 26, 27. While carrying the carrier in either mode, no discomfort is experienced by either the thumb or finger because the depending tabs 28, 30 prevent, or minimize, contact between the raw cut edges of the blank and the thumb and finger of the person carrying the carrier.

It has been found through jerk tests performed on the carriers formed from blanks 11 and 111, that the tearing forces which normally are concentrated in the areas adjacent the ends of the tab-forming cuts are effectively directed away from such areas by having the cut end portions curved outwardly away from one another.

The jerk tests were conducted in an environment of 73° F. with 50% relative humidity. In performing the tests the loaded carrier in the first mode was suspended from a hard leather strap of approximately 1" in width which had been inserted through both fingerholes. With the carrier so disposed it was then subjected to repeated one-inch jerks. In both types of carriers (i.e., one formed from blank 11 and the other formed from blank 111), it was found that no tearing occurred in the center sections even after fifty jerks, whereas with a carrier of substantially the same configuration as the carrier formed from the blank 111, except that the end portions of the fingerhole cuts were not curved, tearing occurred after approximately seven jerks. In all instances, the test carriers were loaded with the same number of articles, and the latter were of the same size, shape, and weight.

In the improved carriers, when converted into the second mode and fully loaded with empty articles, it was found that in all instances the carriers could withstand an additional fifty jerks without any incidents of tearing. As to the conventional carrier, which tore after approximately seven jerks, it was not subjected to the second series of tests because it was not suitable for being converted into a second mode. All carriers, including the improved and conventional designs which were tested, were formed from blanks of the same paperboard sheet material and the same type and amount of adhesive was utilized.

Thus, an improved article carrier has been provided wherein the fingerholes formed in the handle thereof are possessed of a significantly greater resistance to tearing under normal conditions of handling; the fingerholes do not cause discomfort to the person manually carrying same; the improved carrier does not increase the amount or thickness of the material required to form the carrier blank; the improved carrier blank is easy to set up and load with highspeed automatic equipment; and the improved carrier is compact, sturdy, attractive in appearance, and inexpensive. The size and shape of the improved carrier may vary from that shown and described without departing from the scope of the invention.

I claim:

1. A carrier of foldable sheet material for accommodating a plurality of articles arranged in a pair of parallel rows, comprising a base panel for subtending and supporting the rows of articles; upright end wall panels extending from oppositely spaced first peripheral portions of said base panel for disposition adjacent opposite ends of the article rows; upright side wall panels extending from oppositely spaced second peripheral portions of said base panel, each side wall panel adapted to be disposed adjacent a side of an article row; and a handle spanning the distance between the end wall panels, said handle including an elongated single ply center section foldably connected at opposite ends to upper portions of said end wall panels and a pair of elongated side sections foldably connected to opposite elongated side edges of said center section, and, when in one folded mode, extending downwardly and having portions thereof adapted to be disposed between the article rows, said center section being provided with a pair of longitudinally spaced fingerholes, the portion of said center section intermediate said fingerholes being substantially planar and in spaced substantially parallel relation with said base panel, even when the side sections are in the folded mode, said sheet material having a grain extending longitudinally of said center section, each fingerhole having a tab adapted to be struck out from said center section and folded relative thereto in a direction towards said base panel and under the portion of said center section intermediate said fingerholes, said tabs initially extending in opposite directions away from each other, each tab being substantially defined by a substantially continuous curved cut having opposite end portions curved outwardly away from each other and forming a pair of relatively spaced open loops, the open sides of each pair of loops of a cut facing substantially in a direction towards an adjacent end wall panel, the open loops of each cut being disposed at opposite ends of the folding axis of the tab defined by said cut, said tab having a maximum width portion spaced from the folding axis thereof which is greater than the length of the folding axis between said loops, said maximum width being measured in a direction parallel to said folding axis.

2. The carrier of claim 1 wherein the handle center section includes at least one pair of elongated diverging foldlines for each fingerhole, end pair of foldlines extending divergently from the end portion loops of the tab-forming cut in a direction towards the adjacent end wall panel and terminating at the periphery of said center section.

3. The carrier of claim 1 wherein the folding axes of the fingerhole tabs are defined by a pair of spaced foldlines disposed substantially transversely of the longitudinal axis of the elongated center section; each foldline extending between the end portions of a cut.

4. The carrier of claim 1 wherein the side and end wall panels coact with the base panel to form an open top chamber for accommodating the plurality of articles; the handle elongated side sections, when in an initial folded mode, extending outwardly and downwardly from the center section and are connected to upper portions of the upright side wall panels substantially closing the open top of said chamber and retaining the accommodated articles within said chamber and, when in the one folded mode, said handle side sections being disconnected from the upright side wall panels and extending downwardly from the center section into said chamber and forming same into a pair of contiguous open top compartments, each compartment accommodating a row of articles; the portion of the handle center section intermediate the fingerholes remaining substantially planar when said side sections are in either folded mode.

* * * * *